US005172616A

United States Patent [19]

Negishi

[11] Patent Number: 5,172,616

[45] Date of Patent: Dec. 22, 1992

[54] TORQUE WRENCH

[75] Inventor: Masaki Negishi, Kawasaki, Japan

[73] Assignee: TEAC Corporation, Japan

[21] Appl. No.: 775,739

[22] Filed: Oct. 11, 1991

[30] Foreign Application Priority Data

Oct. 13, 1990 [JP] Japan ..... 2-106915

[51] Int. Cl.[5] ..... B25B 23/14

[52] U.S. Cl. ..... 81/467; 81/429; 81/479

[58] Field of Search ..... 81/467, 468, 429, 478, 81/479, 480, 481, 483

[56] References Cited

U.S. PATENT DOCUMENTS

| | | | |
|---|---|---|---|
| 4,091,664 | 5/1978 | Zerver . | |
| 4,279,171 | 7/1981 | Fylling . | |
| 4,328,709 | 5/1982 | Schramm | 81/479 |
| 4,669,819 | 6/1987 | Heyraud | 81/479 |
| 4,958,541 | 9/1990 | Annis et al. | 81/479 |

FOREIGN PATENT DOCUMENTS

| | | | |
|---|---|---|---|
| 3324333 | 1/1985 | Fed. Rep. of Germany | 81/479 |

*Primary Examiner*—Bruce M. Kisliuk
*Assistant Examiner*—Lawrence Cruz
*Attorney, Agent, or Firm*—Andrus, Sceales, Starke & Sawall

[57] ABSTRACT

This torque wrench includes an operating lever, an output shaft rotatable with the operating lever, a one-way rotation restricting system that rotates a threaded part in only one direction, a torque measuring system for measuring clamping torque, a rotating parts group which rotates with an output shaft, a stationary parts group restricted for relative displacement with an object by means of clamping the object, a rotating angle measuring system for measuring a rotating angle toward the object and a measuring output system for outputting values measured by the rotating angle measuring system and the torque measuring system.

8 Claims, 4 Drawing Sheets

TORQUE WRENCH

BACKGROUND OF THE INVENTION

The present invention relates to a torque wrench having a rotating angle measurer, and more particularly, to a torque wrench provided with a device to measure screw rotating angles so as to strictly control fastening torque.

There are three known methods as specified in JAPAN INDUSTRY STANDARD B 1083 for strictly controlling fastening torque when threaded parts such as bolts are fastened. According to one of these methods, fastening is carried out with a torque wrench until the fastening torque reaches a specific torque value while the torque wrench is measuring torque. If the specified torque value is reached, the torque wrench will finish fastening.

The second method is called a rotating angle method, in which fastening of the bolt is carried out with a torque wrench to a specified torque value. To complete fastening, the torque wrench is further rotated to a specific angle.

The third method is called a torque gradient method. In this method, the rotating angle of the bolt and the fastening torque are measured at the same time. The fastening of the bolt is carried out to a specific point obtained from the gradient relation between the above described rotating angle and the fastening torque. This shows that the rotating angle of the bolt and the fastening torque to certain values increase with keeping a proportional relation between the fastening angle and the fastening torque. When a rotating angle is, however, increased from a point approximate to an elastic limit either of the bolt or a object to be fastened with the bolt, torque will not be increased proportionally. If the torque wrench is, nonetheless, further rotated, threads of the bolt will be damaged. The fastening torque is indicated on the ordinate in a graph, and the rotating angle is indicated on the abscissa in the graph.

The torque wrench continues to detect the gradient in the graph. When the gradient in the graph approaches the elastic limit, the fastening of the torque wrench is finished. This torque gradient method enables, consequently, an optimal fastening torque to be applied to the bolt, so as to prevent it from being damaged due to excessively tight fastening.

The torque wrench used in this torque gradient method should be such that the rotating angle of a threaded screw part toward the object body and fastening torque can be simultaneously measured.

FIG. 1 shows a block diagram of a conventional torque wrench. The torque wrench 1 as shown therein gives a specific torque to a screw part, such as a bolt 2, to turn it to secure object bodies 3*a* and 3*b*.

The torque wrench 1 comprises of an operating lever 4*a*, a metallic molded wrench body 4 having a rotary part 4*b* (rotatable 360 degrees) provided at the front end of the operating lever 4*a*, a ratchet 5 consisting of a ratchet wheel 5*a* and a ratchet pawl 5*b* provided on the rotary part 4*b*, as a one-way rotation restrict mechanism, an output shaft 6 projecting downward from the center of the ratchet wheel 5*a*, and a socket 7 fitted onto an output shaft 6 for receiving the head of the bolt 2.

The ratchet wheel 5*a* is provided so as to be rotatable in two directions at the rotary part 4*b*. Thus, the ratchet wheel 5*a* is engaged with the ratchet pawl 5*b* provided at the rotary part 4*b*, whereby the ratchet wheel 5*a* rotates only in a single direction with respect to the rotary part 4*b*.

A bridge circuit (not shown) comprises strain gauges 8 and 9 provided on both sides. The strain gauges 8 and 9 are used to measure strain generated at the position where the operating lever 4*a* is mounted onto the rotary part 4*b* and measure fastening torque applied to the bolt 2.

A rotary encoder 10 is aligned with the center of the output shaft 6 when the encoder is mounted onto the rotary part 4*a*. A rotary part 10*a* of the rotary encoder 10 is fixed at the rotary part 4*b*. The rotary part 4*b* is rotatably provided with a fixture 10*b* in the rotary encoder 10. The fixture 10*b* is secured to a object body 3*c* with a fixing wire 10*c* and a magnet 10*d*. The body 3*c* is not displaced relative to object bodies 3*a*, 3*b*.

Using the ratchet 5 which mechanically restricts rotational movements in one direction, rotational movements of the one direction of the operating lever 4*a* are transmitted to the output shaft 6 to rotate the bolt 2. Any rotational movement in a reverse direction is idled and is not transmitted to the output shaft 6. This will prevent the bolt 2 from rotating in the reverse direction.

Accordingly, the output shaft 6 is rotated in one direction to fasten the bolt 2 by the reciprocal rotational movements of the lever 4*a*. The rotary encoder 10 detects, the reciprocal rotational movements of the rotary part 4*b* toward the object bodies 3*a*, 3*b*, and 3*c*. An operator knows the rotating angle of the bolt by means of the rotary encoder 10 from the detected reciprocal rotary movements of the rotary part 4*b*. The bolt 2 is thus fastened according to the foregoing torque gradient method.

The rotary encoder 10 detects, due to its construction, however, rotational angles of the operating lever 4 in both directions. This means that the rotating angle as measured by the rotary encoder 10 is almost double the rotating angle of the bolt 2. It is necessary for the operator to determine actual rotating angle by deducting the idle rotational angle from the measured rotating angle of the rotary encoder 10. Since such calculations are so complicated, miscalculations may be made at work sites.

In addition, there is a gap for play where the output shaft 6 comes in contact with the socket 7 to facilitate the replacement of such sockets. Movements of the operating lever include a displacement corresponding to such an idle during reciprocating movements. The conventional type torque wrench is, however, unable to detect such displacement and thus the measurements of the detected angles may suffer a lot of errors toward the actual rotating angles.

SUMMARY OF THE INVENTION

Accordingly, a general object of the present invention is to provide a torque wrench having a new and useful rotating angle detector which is able to solve the above-described problems.

A more specific object of the present invention is to provide a torque wrench equipped with a device which can directly measure the actual rotating angle of a bolt when fastening the bolt.

Another object of the present invention is to provide a torque wrench having a rotating angle measure which can accurately measure rotating angles of the bolt.

Other objects and further features of the present invention will become apparent from the following detailed description when read in conjunction with the attached drawings.

DESCRIPTION OF THE PREFERRED EMBODIMENTS

Figure 1:
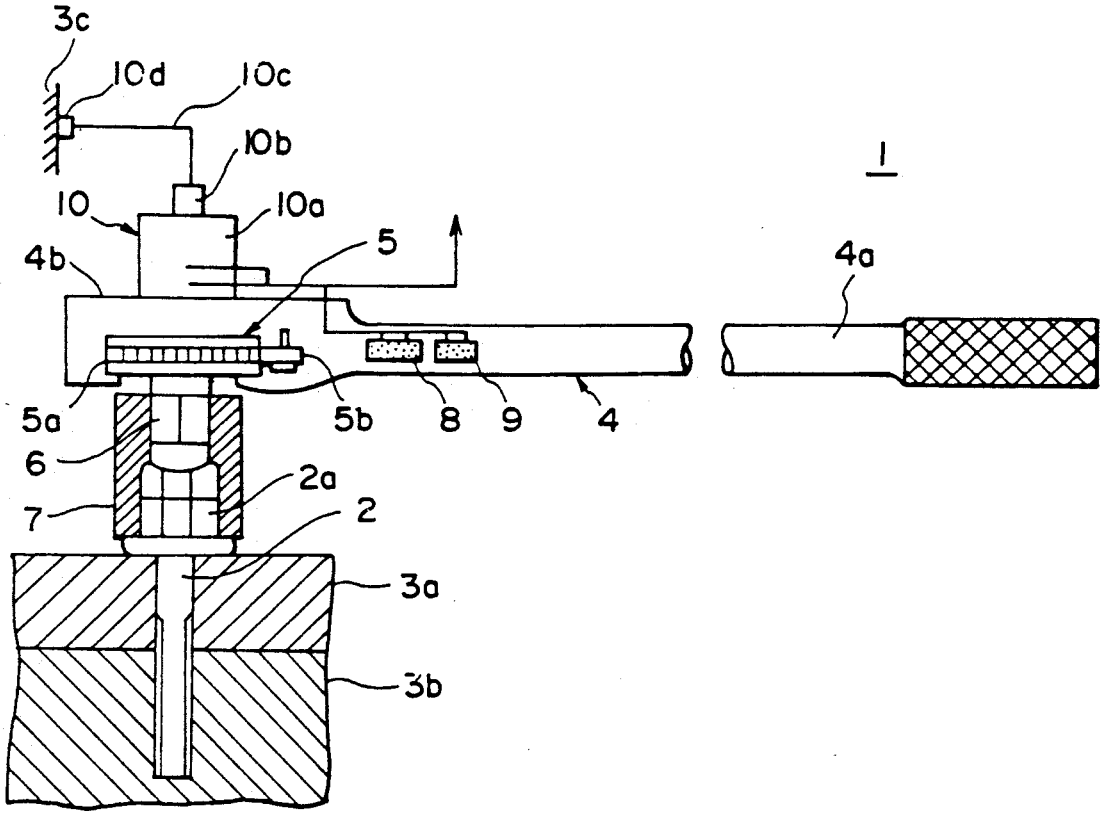
FIG. 1 PRIOR ART
FIG. 1 is a block diagram showing a conventional torque wrench.
Figure 2:
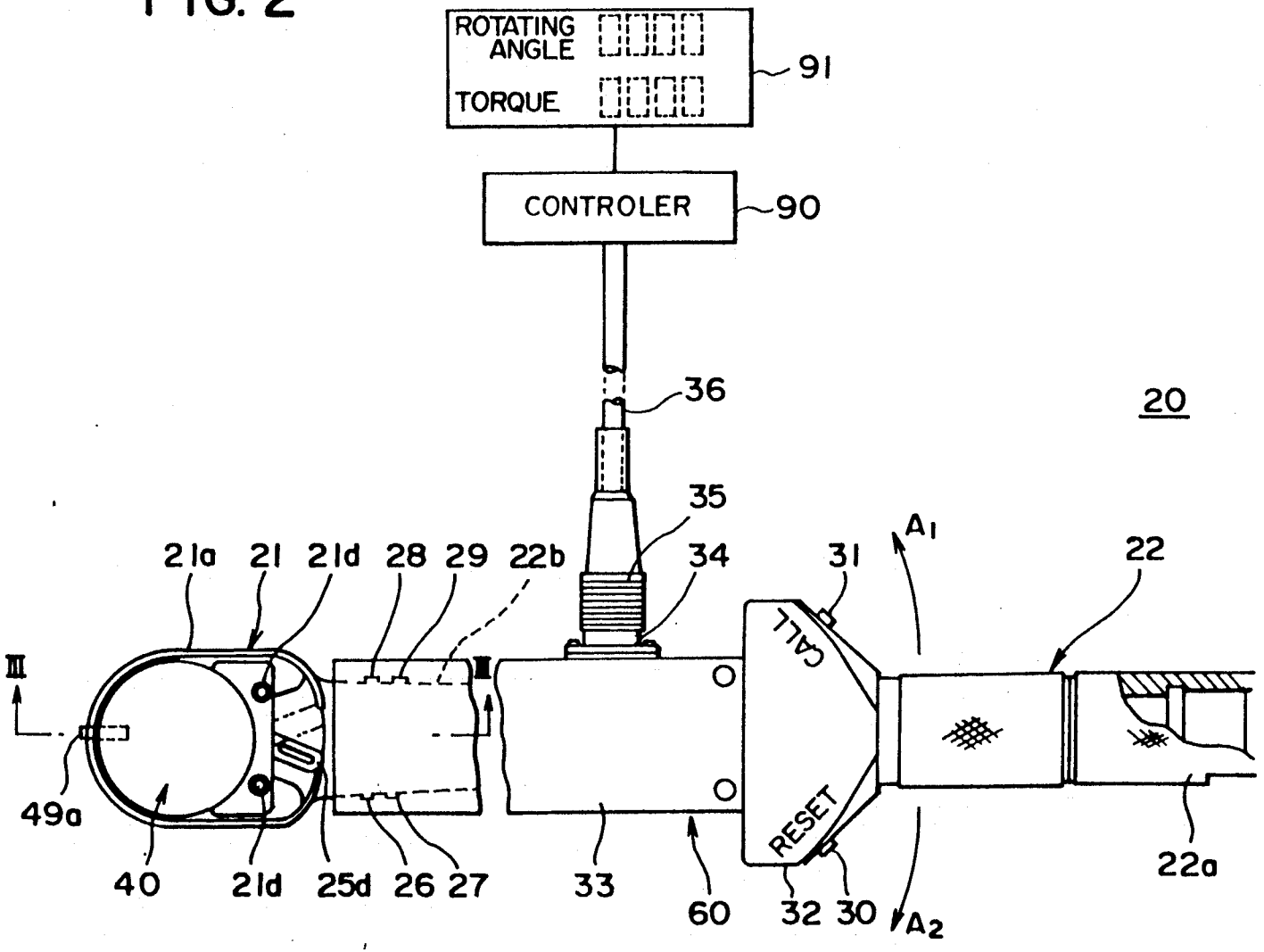
FIG. 2 is a plan view of a torque wrench according to an embodiment of the present invention.
Figure 4:
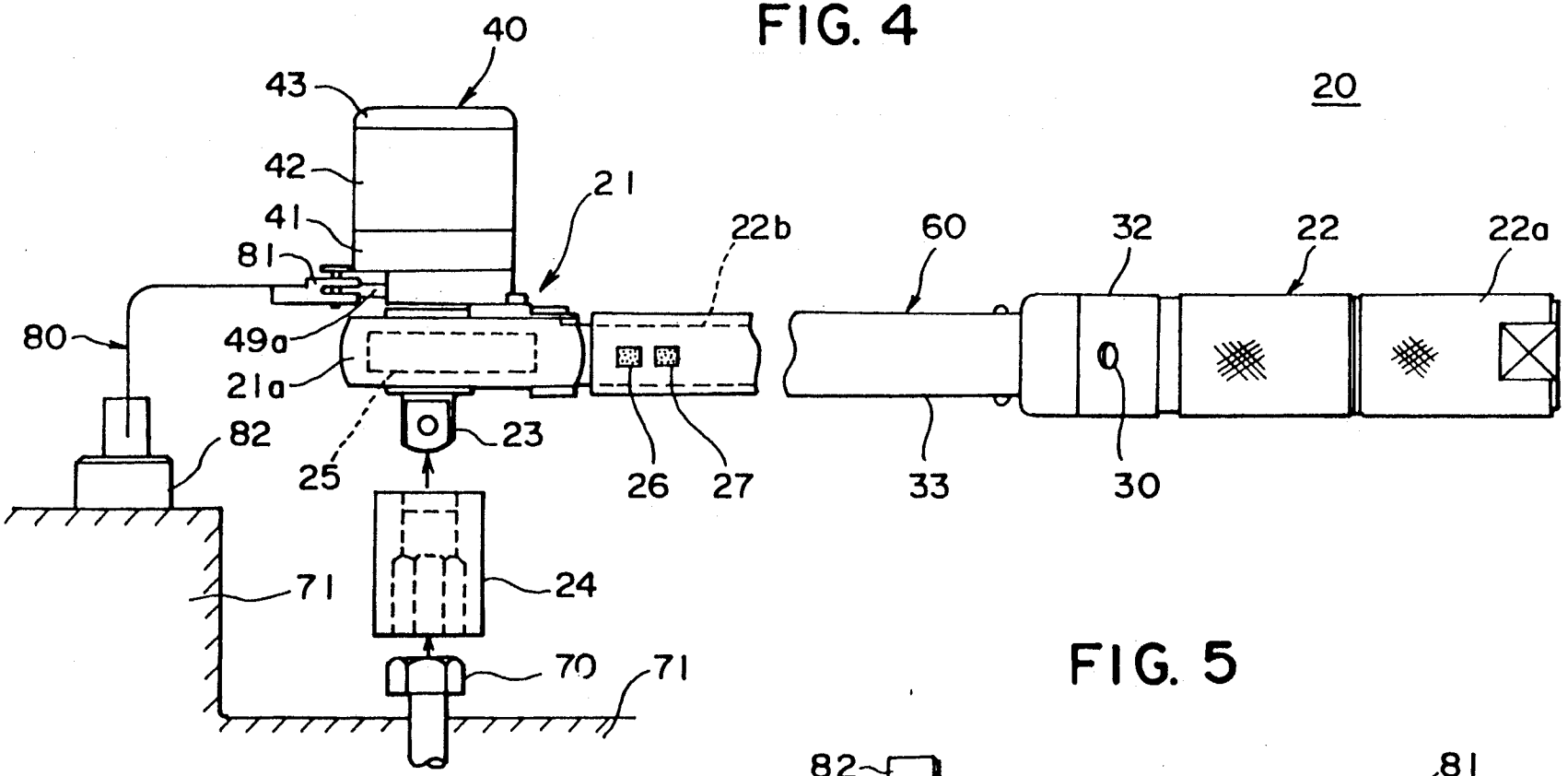
FIG. 4 is a side view of the torque wrench shown in FIG. 2.

In an embodiment of the present invention, a torque wrench 20 is substantially composed of a rotary part 21 and an operating lever 22 as shown in FIG. 2 and FIG. 4. One end of the operating lever 22 is fitted onto the rotary part 21 and the other end thereof has a manually held grip 22*a*. The rotary part 21 and the operating lever 22 are integrally made of rigid metal.

The rotary part 21 is provided with a socket 24 in which a head of a bolt 70 is fitted, a rotatable square-shaped output shaft 23, a ratchet 25 to regulate rotational direction of the output shaft 23, and a rotating angle measurer 40 to measure the rotating angle of the output shaft 23.

Strain gauges 26, 27, 28 and 29 for measuring fastening torque are placed longitudinally, on both sides of the torque wrench, two on each side. A switch portion 32 consisting of control switches 30 and 31 is provided adjacent to the grip 22*a* of a shank 22*b* in order to control measurements made by means of the rotating angle detector 40 and the strain gauges 26, 27, 28 and 29. A covering member 33 is provided between the switch portion 32 and the rotary part 21 to cover the shank 22*b*. One end of the covering member 33 is fixed to the switch portion 32, and the other end thereof is free. There is a gap in the covering member 33 between the end face of the rotating part 21 and the shank 22*b* so that the rotating part 21 will not come into contact with the strain gauges 26 to 29.

A receptacle 34 and a plug 35 are provided on one side of the covering member 33. Wires extending from the rotating angle measurer 40 and the strain gauges 26, 27, 28 and 29 are connected to an external controller 90 by way of the receptacle 34 and the plug 35.

Figure 3:
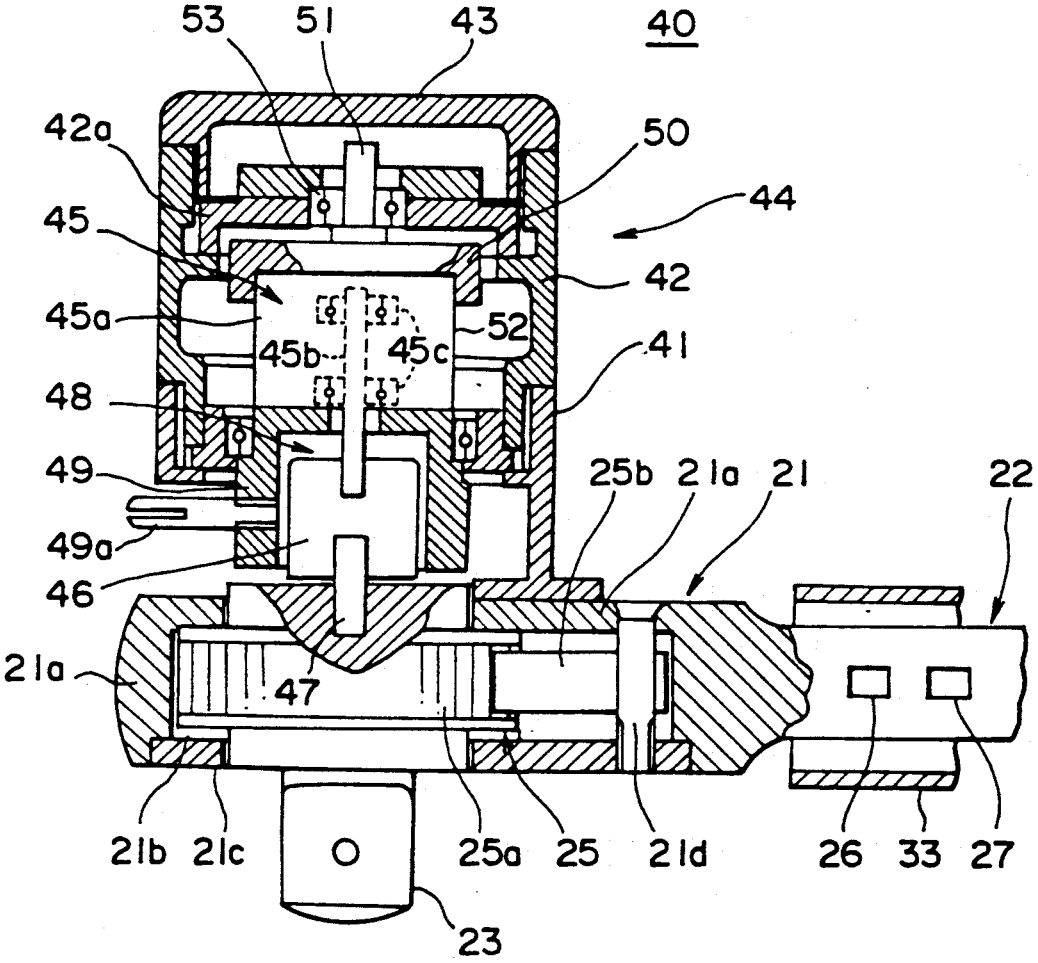
FIG. 3 is a vertical sectional view of the torque wrench shown in FIG. 2, as taken along line III—III in FIG. 2.

A description of the construction of the rotary part 21 and that of the rotating angle detector 40 will now be given with reference to FIG. 2 and FIG. 3.

A rotary part main body 21*a* integral with the operating lever 22 has a concave space 21*b* with a downward opening. The ratchet 25 is provided in the space 21*b* to regulate one-way rotation. The ratchet 25 is composed of a ratchet wheel 25*a* and a ratchet pawl 25*b*. The ratchet wheel 25*a* is provided to be rotatable in two directions in the space 21*b*. The ratchet wheel 25*a* is integrally engaged with the center of square shaped output shaft 23. The output shaft 23 projects downward from the rotary part 21 through a lid member 21*c* of the concave space 21*b* having the downward opening. The lid member 21*c* is fixed to the rotary part body 21*a* by a screw 21*d*.

The ratchet pawl 25*b* of the ratchet 25 engages with teeth around the ratchet wheel 25*a* to restrict the one-way rotation of the ratchet wheel 25*a*. As shown in FIG. 3, the output shaft 23 is selectively rotatable either in a clockwise or counterclockwise direction according to a position of the output shaft 23 set by a switch lever 25*d* for turning the ratchet wheel 25*a*.

A wrench main body 60 is composed of the operating lever 22, rotary main body 21*a*, ratchet 25*a* and output shaft 23 provided at the rotary main body 21*a*. The rotating angle detector 40 is provided on top of the rotary part 21.

A rotary parts group 44 of the rotating angle detector 40 comprises of a first cover 41 fixed to the rotary part 21, a second cover 42 fastened to the first cover 41, a third cover 43 fastened to the second cover 42 and a bearing retainer 42*a* provided between the second cover 42 and cover 43. The rotary parts group 44 comprises parts fixed to the rotary part 21.

A rotary parts group 48 which rotates as the socket 24 turns the bolt 70 is composed of a rotary part 45*b* of an integral rotary encoder 45, a flexible coupling 46, a linkage shaft 47 and the ratchet wheel 25*a*. The rotary encoder 45 is provided inside the rotary parts of the rotary parts group 44, and it comprises a fixed part 45*a* and the rotary part 45*b*. The rotary encoder 45 outputs to a controller 90 pulse signals each having an angle proportionate to the relative rotating angle of the fixed part 45*a* and rotary part 45*b*. The rotary part 45*b* of the rotary encoder 45 is connected to the ratchet wheel 25*a* by way of the flexible coupling 46 and the linkage shaft 47, whereby the rotary parts group 48 rotates in response to the rotating of the bolt 70. In addition, the flexible coupling 46 absorbs displacement due to idling in the ratchet wheel 25*a* in axial and radial directions, and transmits displacement to the rotary encoder 45 only in the circumferential direction.

A stationary parts group 52 is comprised of the fixed part 45*a* of the rotary encoder 45, a dome-shaped support member 49 provided at the bottom of the encoder 45 and having a radially projecting engaging pin 49*a* projected radially, a crown-shaped member 50 provided on top of the fixed part 45*a* and a top-end shaft 51. The rotary parts group 44 is fixed to the rotary part 21 and is integrally rotatable therewith relative to the rotary parts group 52. Furthermore, the stationary parts group 52 of fixed members is rotatable relative to the rotary parts group 48 by a pair of bearings 45*c* in the rotary encoder 45.

As described above, the rotating angle detector 40 is divided into three groups, namely the rotary parts group 44, the rotary parts group 48, and the stationary parts group 52, each group having different functions.

An operational description of the torque wrench 20 will now be given. As shown in FIG. 4, the socket 24 is fitted onto the output shaft 23, and the bolt 70 fits into the socket 24. This enables the rotational movement of the output shaft 23 to be transmitted to the bolt 70.

The torque wrench 20 of the present embodiment rotates the bolt 70 in the same manner as the conventional torque wrench 1. As indicated by arrows $A_1$ and $A_2$ in FIG. 2, when the grip 22*a* rotationally reciprocates in the circumferential direction the output shaft 23, the ratchet 25 transmits a rotational movements only in either direction $A_1$ or $A_2$ to the output shaft 23. The bolt 70 thereby rotates only in a single direction. The ratchet 25 operates in the same manner as the conventional torque wrench 1 to convert the above reciprocal movement into a one-way movement.

The following description concerns to the rotating angle detector 40 when it is fastening the bolt 70. As seen in FIG. 2 and FIG. 4, to screw the bolt 70 to an object 71, the operator fits the socket 24 fixed onto the output shaft 23 of the torque wrench 20 onto the bolt 70. The operation then turns the operating lever 22 to reciprocate it in the circumferential directions $A_1$ and $A_2$ around the output shaft 23. As the rotary part 21*a* is also reciprocated at this time, the rotary parts group 44 is made to reciprocate.

If a switch lever 25*d* is set so that the operating lever 22 engages with the ratchet wheel 25*a* especially when the operating lever 22 rotates in the direction $A_2$ for reciprocation, the ratchet wheel 25*a* and the output shaft 23 turn together with the operating lever 22 to rotate the bolt 70 in the direction $A_2$. If the operating lever 22 rotates, on the contrary, in the direction $A_1$ for reciprocation, the ratchet 25 acts to disengage the operating lever 22 from the ratchet wheel 25*a*, and the bolt 70 will be stationary in the object 71.

The rotary parts group 44 is rotatable relative to the rotary parts group 48. Accordingly, the rotary members group 48 rotates in response to the rotational movement of the bolt 70 without being influenced by the rotating of the rotary parts group 44.

Figure 5:
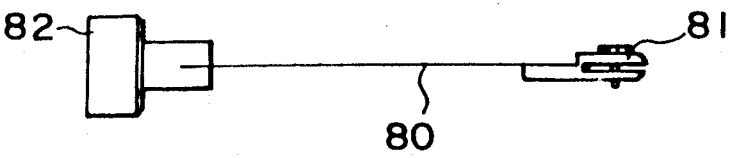
FIG. 5 is a side view of an engaging means as shown in FIG. 4.

An engaging means 80 of the stationary parts group 52 will now be described. FIG. 5 is a side view of the engaging means 80 of an embodiment of the present invention. A clip 81 is provided at one end of the engaging means 80. As shown in FIG. 4, the clip 81 is fitted onto an engaging pin 49*a* in the support member 49. A magnet 82 is provided on the other end of the engaging means 80 and secured to the object 71 into which the bolt 70 is screwed. Since the clip 81 is coupled to the magnet 82 by means of an elastic metallic sheet, the engaging pin 49*a* is positioned in accordance with the direction in which the object 71 rotates. This means that when the bolt 70 is fastened, the stationary parts group 52 linked with the engaging pin 49*a* will be fixed to the object 71 by the engaging means 80 even if the rotary parts group 44 and rotary parts groups 48 rotate as described above.

As a result, the fixed part 45*a* of the rotary encoder 45 is indirectly connected with the object 71. The fixed part 45*a* and the object 71 are maintained in stationary. On the other hand, the rotary part 45*b* of the rotary encoder 45 is rotate, as the bolt 70 is turned. This makes it possible for the rotary encoder 45 to determine a relative rotating angle in terms of the fixed part 45*a* and the rotary part 45*b*. Such a rotating angle coincides with that of the bolt 70 toward the object 71.

The torque wrench 20 of the present invention will now be compared with the conventional torque wrench 1 in which the rotary part 10*a* of the rotary encoder 10 is mounted on top of the rotary part 4*b*, and the stationary part 10*b* is secured to an object body 3*c*. In the conventional torque wrench 1, the idling rotational movement (in the direction $A_1$ in the above embodiment) relative to the bolt 2 is also measured as the rotating angle of the bolt 2. However, as the torque wrench 20 of the present embodiment is equipped with the rotary part 45*b* of the rotary encoder 45 which is mounted onto to a member indirectly connected to the bolt 70, the rotating angle of the operating lever 22 when it is idling is not measured. Instead, the angle of rotation of the operating lever 22 in only the same direction as the bolt 70 rotates is measured by the rotating angle measurer 40.

Accordingly, the actual rotating angle of the bolt 70 toward the object 71 can be directly measured with the torque wrench 20 of the present embodiment. In addition, the output shaft 23 is rotated by displacement in a single direction, so that any displacement due to idling between the bolt 70 and the output shaft 23 as described above is not detected by the rotating angle measurer 40. This enables the rotating angle measurer 40 to provide accurately measured rotating angles.

The strain gauges 26–29 attached onto the shank 22*b* are electrically connected to form a bridge circuit (not shown) as in the conventional torque wrench. The bridge circuit outputs signals representing the fastening torque applied to the bolt 70. The rotating angle detected by the rotating angle detector 40 and fastening torque signals are inputted into the controller 90 by way of a cable 36. Such inputted signals are then supplied by the controller to a digital displaying means 91 for displaying in a digital display manner.

With the torque wrench 20 of the present embodiment, the operator is able to fasten bolts according to the torque gradient method while looking at the actually measured rotating angle and fastening torque displayed.

Furthermore, if the controller 90 is so controlled that it causes a buzzer to sound when the relation of a rotating angle to fastening torque turns out to be as specified, the operator is able to carry out fastening without looking at the displaying means. This will save the operator from having to calculate displayed data, thus enabling him to avoid making calculating mistakes.

If the torque wrench 20 of the present embodiment is used in the foregoing rotating angle method, bolts will be fastened securely.

Further, the present invention is not limited to the embodiments described heretofore, and various variations and modifications thereof may be made without departing from the scope of the invention.

What is claimed is:

1. A torque wrench for use with a socket adapted for fitting onto the head of a threaded member to be screwed into an object, said torque wrench comprising:

an operating lever having a first end with an axis of rotation and a second end with a manually held grip;

an output shaft means coupable to said socket for rotating said socket;

one-way rotation restricting means interposed between said operating lever and said output shaft means for mounting said output shaft means on said operating lever along said axis of rotation and for converting reciprocal arcuate movement of said operating lever about said axis of rotation to unidirectional, driving rotation of said output shaft means;

torque measuring means for detecting strain in said operating lever and measuring fastening torque applied to said threaded member when said threaded member is screwed into said object;

a rotary parts group which rotates together with said output shaft;

a stationary parts group adapted to be secured to said object to be stationary with respect to said object, irrespective of the movement of said operating lever, said rotating parts group being rotatable relative to said stationary parts group;

rotating angle measuring means for measuring a rotating angle of said threaded member with respect to the object by measuring a relative rotating angle of said rotary parts group with respect to said stationary parts group; and measuring output means for outputting values measured by said rotating angle measuring means and said torque measuring means.

2. A torque wrench as claimed in claim 1, wherein said torque measuring means includes strain gauges for measuring strain in said operating lever, and a control unit for electrically processing the outputs of the strain gauges.

3. A torque wrench as claimed in claim 1, wherein said stationary parts group comprises:

a support member positioned proximate to said rotary parts group and having an engaging member;

a clip coupled to said engaging member;

a stationary means secured to said object; and engaging means which couples said clip to said stationary means.

4. A torque wrench as claimed in claim 3, wherein said stationary means includes a magnet to be attached to the object.

5. A torque wrench as claimed in claim 3, wherein said engaging means is a metallic sheet.

6. A torque wrench as claimed in claim 1, wherein said rotating angle measuring means comprises a rotary encoder having a fixed part which remains stationary when said threaded member and rotary parts group rotates; and wherein said rotating angle measuring means measures a rotating angle of said rotary parts group relative to said fixed part.

7. A torque wrench as claimed in claim 1, wherein said measuring output means includes displaying means for displaying rotational angles of said threaded part and measured fastening torque.

8. A torque wrench as claimed in claim 1, wherein said measuring output means includes alarm means for announcing by alarm when said rotational angle of said threaded member and fastening torque have reached a specified value.

* * * * *